United States Patent [19]

Franklin et al.

[11] Patent Number: 4,794,707

[45] Date of Patent: Jan. 3, 1989

[54] SHOE WITH INTERNAL DYNAMIC ROCKER ELEMENT

[75] Inventors: Craig A. Franklin, Lynn; Rui M. Parracho, Peabody; Lloyd S. Smith, Newton Center; Richard P. Bunch, Reading; Jack A. Boys, II, Haverhill; Alexander L. Gross, Boston; Robert W. Pagluiso, Methuen, all of Mass.

[73] Assignee: Converse Inc., North Reading, Mass.

[21] Appl. No.: 68,903

[22] Filed: Jun. 30, 1987

Related U.S. Application Data

[63] Continuation-in-part of Ser. No. 879,897, Jun. 30, 1986.

[51] Int. Cl.[4] ..... A43B 13/12; A43B 13/18; A43B 13/00

[52] U.S. Cl. ..... 36/107; 36/30 R; 36/31; 36/35 R

[58] Field of Search ..... 36/30 R, 30 A, 31, 32 R, 36/102, 107, 91, 76 R, 35 R, 43, 44, 28, 37, 108; 128/80 D, 586, 589, 590, 594, 595

[56] References Cited

U.S. PATENT DOCUMENTS

| | | | |
|---|---|---|---|
| 930,990 | 8/1909 | Rogers | 36/35 R |
| 1,592,839 | 7/1926 | Siegfried | 36/35 R |
| 1,607,896 | 3/1926 | Kelly | 36/31 |
| 2,124,819 | 7/1938 | Hanoran | 36/30 A |
| 2,126,601 | 8/1938 | Bain | 36/30 A |
| 2,240,835 | 5/1941 | Cobb | 36/35 R |
| 2,362,497 | 11/1944 | Moore | 36/76 R |
| 2,407,498 | 9/1946 | Johnson | 36/108 |
| 3,161,970 | 12/1964 | Purtell | 36/43 |
| 4,033,054 | 7/1977 | Fukuoka | 36/91 |
| 4,124,946 | 11/1978 | Tomlin | 36/43 |
| 4,133,118 | 1/1979 | Khalsa et al. | 36/44 |
| 4,241,523 | 1/1980 | Daswick | 36/30 |
| 4,316,335 | 2/1982 | Gese et al. | 36/35 R |
| 4,364,188 | 12/1982 | Turner et al. | 36/91 |
| 4,364,189 | 12/1982 | Bates | 36/31 |
| 4,537,060 | 12/1985 | Kawashima | 36/30 R |
| 4,580,359 | 4/1986 | Kurrash et al. | 36/107 |
| 4,608,768 | 9/1986 | Cavanagh | 36/30 R |

FOREIGN PATENT DOCUMENTS

| | | | |
|---|---|---|---|
| 537883 | 11/1931 | Fed. Rep. of Germany | 36/30 A |
| 2272618 | 4/1961 | France . | |
| 2499377 | 8/1982 | France | 36/91 |
| 1437329 | 5/1976 | United Kingdom | 36/76 R |

*Primary Examiner*—Steven N. Meyers
*Attorney, Agent, or Firm*—Bromberg, Sunstein & Casselman

[57] ABSTRACT

A shoe for casual or athletic footwear which provides support cushioning and walking comfort due to the presence of an internal dynamic rocker element disposed in a forefoot area of the midsole.

12 Claims, 4 Drawing Sheets

SHOE WITH INTERNAL DYNAMIC ROCKER ELEMENT

This application is a continuation-in-part of Ser. No. 879,897, filed June 30, 1986.

DESCRIPTION

The present invention relates to shoes in general and in particular to casual and athletic footwear providing support, cushioning, and walking comfort due to the presence of an internal dynamic rocker element in conjunction with a support system.

BACKGROUND OF THE INVENTION

It has long been an object of shoe designers to provide wearers with an optimum combination of comfort and support. Problems addressed by the prior art include: cushioning impacts against the pavement or other walking surface, preventing pronation, and providing support to promote a natural gait. The various elements employed by shoe designers to promote these and other ends include heel plugs, shanks, and contoured soles. Heel plugs and other similar devices used to cushion walking are known in the art. See, for example, Haag, U.S. Pat. No. 1,724,349, and McMahon, U.S. Pat. No. 4,342,158. Shanks of various shapes are known. See, for example, Browne, U.S. Pat. No. 819,845. However, it is not known in the prior art to embed a dynamic rocker element in the midsole, nor is it known in the prior art to combine these with heel plugs and shanks or similar elements to take advantage of any structural interaction they may have.

DISCLOSURE OF INVENTION

The present invention is directed to providing a firm, but resilient dynamic rocker element in the forefoot section of the midsole, which helps propel the foot forward during the latter portion of the gait. In a preferred embodiment, this feature is present in a shoe that also has a specially designed anti-G-force capsule, and an anti-torsion member that interact with the dynamic rocker element and each other to prevent pronation, provide cushioning from the shocks associated with day-to-day walking on various surfaces, and allow for efficient utilization of the energy imparted during the walking process.

DESCRIPTION OF SPECIFIC EMBODIMENTS

Figure 1:
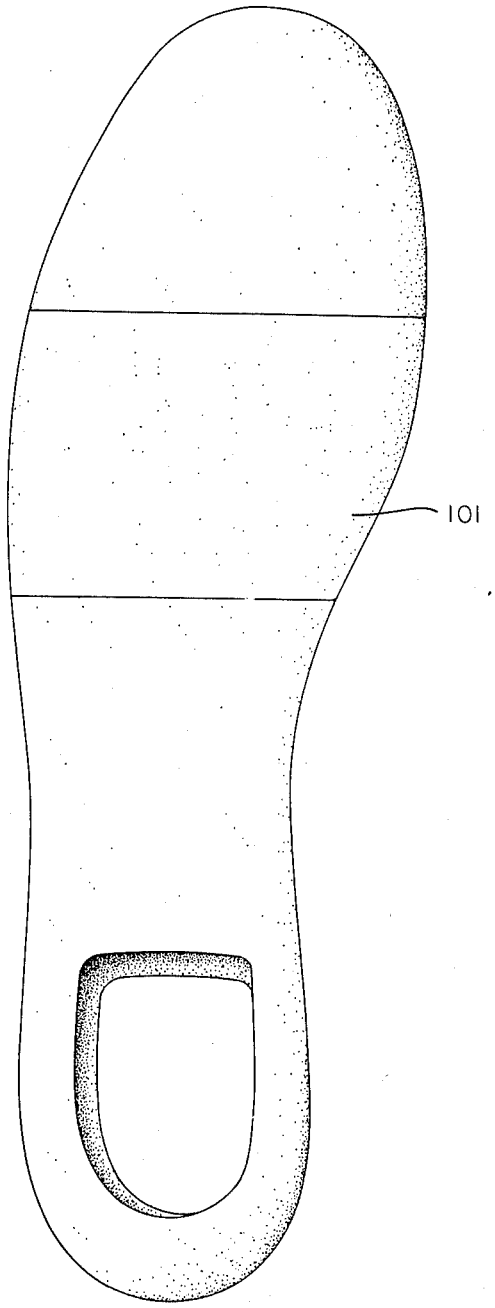
FIG. 1 shows a top view of a midsole containing a dynamic rocker element in accordance with a preferred embodiment of the present invention.

FIG. 1 shows a top view of a midsole containing a rocker element 101 embedded therein in accordance with a preferred embodiment of the invention. The rocker element 101 is an integral structure that extends across the width of the shoe in the area beneath and surrounding the ball of the foot.

Figure 2:
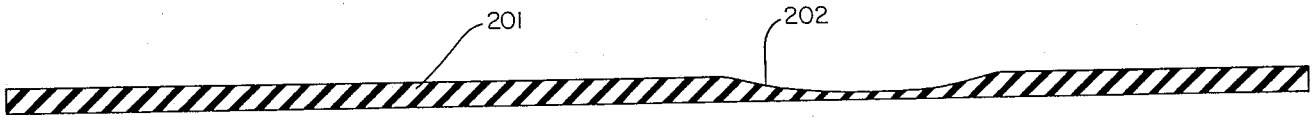
FIG. 2 shows a cross-section of the midsole of a preferred embodiment of the invention including a recess for receiving a dynamic rocker element.
Figure 3A:
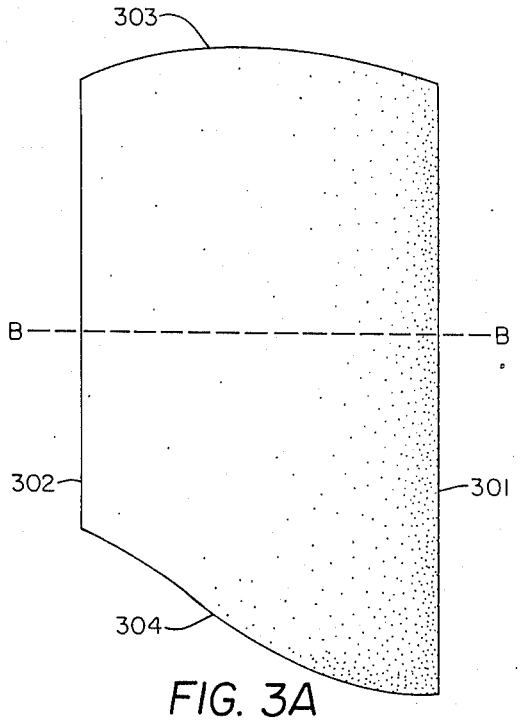
FIG. 3A shows a top view of the dynamic rocker element for use with the embodiment of FIG. 2.
Figure 3B:
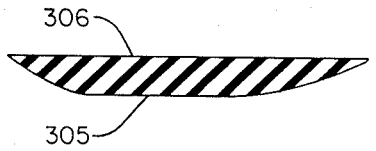
FIG. 3B is a cross-section of the rocker element of FIG. 3 taken along a line extending from the toe area to the heel area.

FIG. 2 shows an embodiment wherein the midsole 201 has a smooth concave recess 202 which receives a rocker element. FIG. 3 shows the shape of a rocker element for a left shoe. FIG. 3A is a top view. The rocker element has a pair of opposing edges 301 and 302 that are roughly parallel to each other, whereas the pair of opposing edges 303 and 304 follow the general outline of the sole. FIG. 3B shows a cross-section of the rocker element taken through plane B—B of FIG. 3A, which is a reference plane extending from the toe section of the shoe to the heel section. In cross-section the rocker element has a convex arcuate lower surface 305 joined to a roughly planar surface 306 the internal rocker element is disposed so as to form a geometrical solid. It is the rounded shape of the rocker's lower surface 305, along with its rigidity, which enables it to assist in thrusting the forefoot downward and the heel upward during the latter portion of the step, which enhances motion of the foot. The rocker element may be made from a number of materials, subject to the condition that it is less flexible that the midsole surrounding it. In a preferred embodiment it is made from ethylene vinylacetate, with a density of approximately 70 on a C durometer scale. Other materials which also may be used include polyurethane, polyvinyl chloride, styrene butadiene rubber (SBR) and thermoplastic rubber (TPR).

Figure 4:
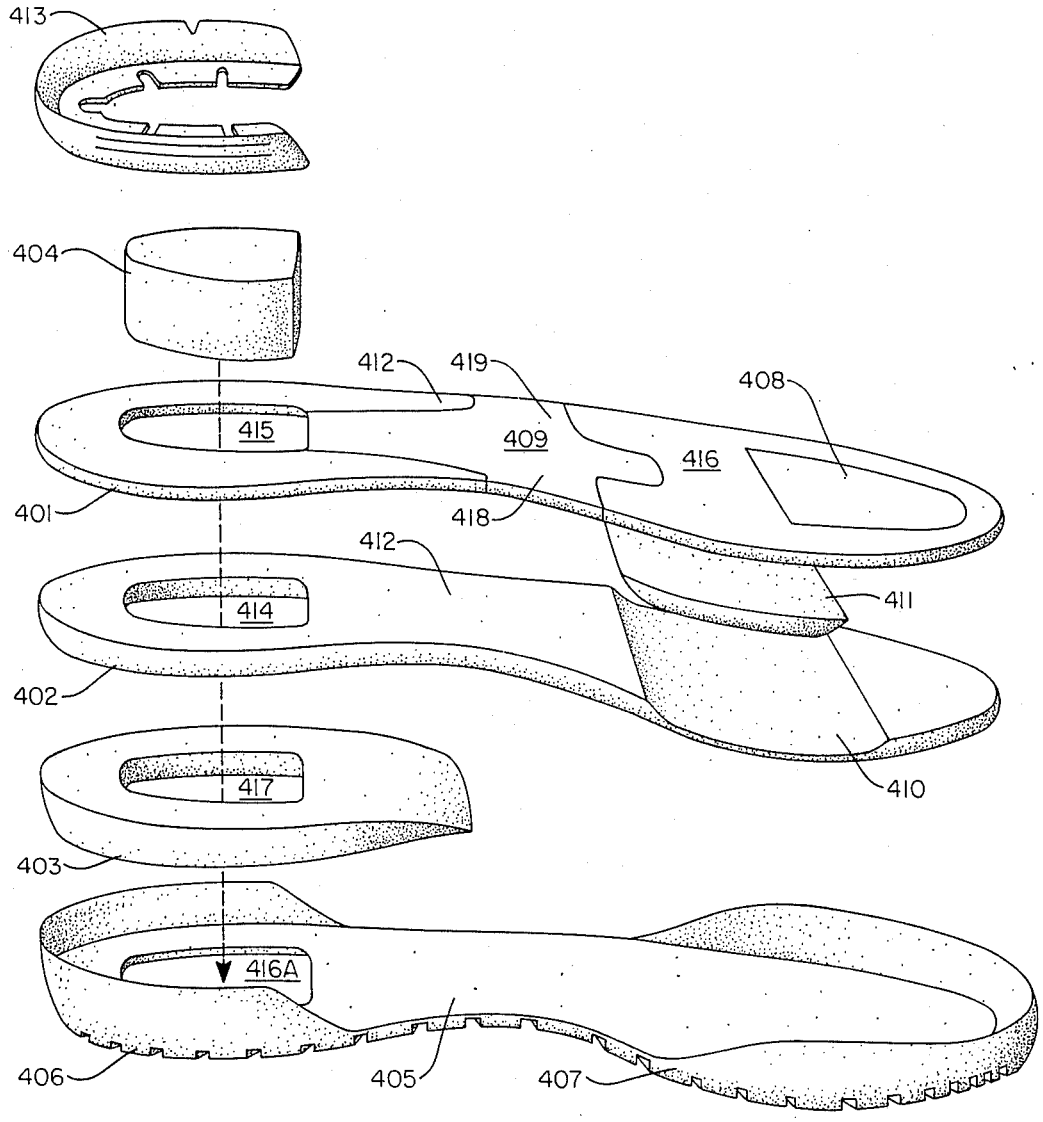
FIG. 4 shows an exploded view of one embodiment of the invention utilizing the components illustrated in FIGS. 2, 3A, and 3B.

FIG. 4 shows an embodiment wherein the midsole is formed of two layers. A force moderator layer, 412, composed of a rubber modified ethylene vinyl acetate (EVA) blown microcellular material, forms the lower midsole layer 402 and has an aperture 414 in the heel portion, and a recess 410 disposed across its width in the forefoot area. The upper midsole layer 401 is also composed of a rubber modified EVA blown microcellular material 412 with an aperture 415 in the heel portion. Within the forefoot section of the upper midsole layer 401 is a layer of highly energy efficient and compliant type of ethylene vinyl acetate (EVA) blown material 408, nested within a stable perimeter 416 of higher density ethylene vinyl acetate (EVA) blown material.

A highly resilient semi-rigid anti-torsion member 409, which is made of thermoplastic material, is disposed within the upper midsole layer with a central axis lying in a complementary shaped recess along the central axes of the midsole, the rear portion of the anti-torsion member lying proximate to the aperture 415 in the heel portion of the midsole. The anti-torsion member includes two integrally formed arms 418 and 419 transversely disposed with respect to the central axis of the shank and extending towards the side of the midsole. The purpose of the member is to assure that when the knee and the forefoot flexes, the rear portion of the shoe does not.

An anti-G-force heel capsule 404 made of a special polyethylene, ethylene vinyl acetate, rubber (PE/EVA/rubber) blend of blown microcellular material with a durometer of approximately 50±3 on the Asker C scale extends through the apertures 414 and 415 in the upper and lower midsole layers and into the aperture in the heel portion of the outsole. The rubber may, for example be styrene butadiene rubber (SBR), polyisobutadiene, or polyisoprene. The purpose of the force moderation layers in combination with the anti-G-force capsule 404 is to provide well distributed shock absorption to the calcaneal portion of the foot.

Cradled in recess 410 of the midfoot section of the lower midsole 402 is the internal dynamic rocker element 411. The rocker element co-operates with anti-torsion member 409 to provide a surface which translates the motion imported to the area under the ball of the foot into a rocking motion, resulting in a more comfortable and easier stride. The rocker element may be placed in a conventional midsole in a manner similar to that illustrated herein, the requirement being that the rocker element should be less flexible than adjacent portions of the midsole.

The outsole 405 of the present embodiment is composed of solid rubber and the heel portion has an aperture 416 therein having side walls. In this embodiment, the aperture 416 in the outsole is smaller in area than the collective aperture 414 and 415 in the heel portion of the midsole so that the heel capsule extends most of the way through the collective aperture, leaving a gap between the capsule and a walking surface. In a preferred embodiment, the outsole 405 has sidewall 406 extending upward from the base of the outsole 405 and around the heel portion of the midsole and sidewall 407 also extending upward around the toe region of the outsole.

In a preferred embodiment, a rear foot stabilizer 413 made of polyurethane or a solid PVC elastomer is provided above the midsole along the back portion of rearfoot section which stabilizes the heel of the foot during motion.

Finally, in a preferred embodiment, a perimeter support wedge 403 composed of ethylene vinyl acetate (EVA) and having a durometer of approximately 70 on the Asker C scale is provided between the midsole and the outsole in the heel portion of the shoe and extending forward therefrom. The support wedge 403 is tapered along the bottom edge toward the front of the sole of the shoe and terminates to the rear of the transverse arms 418 and 419 of the anti-torsion member 409 lying above it. The support wedge 403 also has an aperture 417 in the heel portion thereof coincident with the apertures 414 and 415 in the midsole layers, through which the heel capsule extends. The perimeter support wedge 40 provides cushioned support for the heel and medial arch and in conjunction with the dynamic rocker element 411, the anti-torsion member 409 and the heel capsule 404, distributes shock absorption along the entire foot while providing support to promote a natural gait.

What is claimed is:

1. A shoe comprising:

(i) a substantially planar outsole including a sole portion and a heel portion;

(ii) a flexible midsole attached to the top of the outsole, and having a forefoot area; and (iii) an internal rocker element disposed in the forefoot area of the midsole, the internal rocker element having a substantially planar upper surface and a convexly curved lower surface disposed so as to form a geometrical solid and fabricated out of a material which renders the internal rocker element less flexible and substantially more rigid than adjacent portions of the midsole, so as to assist in thrusting the forefoot downward and the heel upward in the course of the wearer's gait, when the region of the shoe portion proximate to such element is in contact with the ground.

2. A shoe according to claim 1, wherein the forefoot area of the midsole has a recess disposed across its width and the internal rocker element is disposed in the recess.

3. A shoe comprising:

(i) an outsole including a sole portion and a heel portion, the heel portion including an aperture therein having side walls;

(ii) a flexible midsole having a central axis and two sides attached to the top of the outsole, the midsole including a heel portion with an aperture therein having sidewalls and the midsole further including a forefoot area with a first recess disposed across the width of the forefoot area;

(iii) an internal rocker element disposed in the first recess of the forefoot area, the internal rocker element having a planar upper surface and a convexly curved arcuate lower surface, and fabricated out of a material which renders the internal rocker element less flexible than the midsole;

(iv) an anti-torsion member with a central axis lying in a complementarily shaped second recess along the central axis of the midsole, the rear portion of the anti-torsion member lying proximate to the upper portion of the heel capsule, such member further including two integrally formed arms transversely disposed with respect to the central axis of the shank, and extending towards the sides of the midsole;

(v) a heel capsule having side walls and extending through the apertures in the heel portion of the midsole and the outsole, wherein the side walls are generally conformable to those of the apertures; and (vi) such midsole including an energy efficient forefoot section, nested within a higher density perimeter, adjoining the anti-torsion member.

4. A shoe according to claim 3, wherein the heel capsule extends most of the way through the aperture in the heel portion of the shoe, leaving a gap between the capsule and a walking surface.

5. A shoe according to claim 3, wherein the anti-torsion member is resilient.

6. A shoe according to claim 3, further including a perimeter support wedge in the heel portion thereof between the outsole and midsole and made of material less flexible than the midsole, wherein the perimeter support wedge has an aperture in the heel portion thereof.

7. A shoe according to claim 3, further including a rear foot stabilizer above the midsole and curving around the perimeter of the heel capsule, wherein the rear foot stabilizer has sidewalls extending around the heel of the foot of the wearer.

8. A shoe according to claim 3, wherein the midsole is composed of two layers, an upper midsole layer and a lower midsole layer and wherein, (i) the anti-torsion member is disposed in the upper midsole layer (ii) the first recess is disposed in the lower midsole layer and (iii) the internal rocker element is disposed in the first recess between the upper midsole layer and the lower midsole layer.

9. A shoe according to claim 4, wherein the midsole is composed of two layers, and upper midsole layer and a lower midsole layer and wherein, (i) the anti-torsion member is disposed in the upper midsole layer (ii) the first recess is disposed in the lower midsole layer and (iii) the internal rocket element is disposed in the first recess between the upper midsole layer and the lower midsole layer.

10. A shoe according to claim 5, wherein the midsole is composed of two layers, an upper midsole layer and a lower midsole layer and wherein, (i) the anti-torsion member is disposed in the upper midsole (ii) the first recess is disposed in the lower midsole layer and (iii) the internal rocker element is disposed in the first recess between the upper midsole layer and the lower midsole layer.

11. A shoe according to claim 6, wherein the midsole is composed of two layers, an upper midsole layer and a lower midsole layer and wherein, (i) the anti-torsion member is disposed in the upper midsole layer (ii) the first recess is disposed in the lower midsole layer and (iii) the internal rocker element is disposed in the first recess between the upper midsole layer and the lower midsole layer.

12. A shoe according to claim 7, wherein the midsole is composed of two layers, an upper midsole layer and a lower midsole layer and wherein, (i) the anti-torsion member is disposed in the upper midsole layer (ii) the first recess is disposed in the lower midsole layer and (iii) the internal rocker element is disposed in the first recess between the upper midsole layer and the lower midsole layer.

* * * * *